US006098916A

United States Patent [19]

Matteucci et al.

[11] Patent Number: 6,098,916

[45] Date of Patent: Aug. 8, 2000

[54] MACHINE AND METHOD FOR PRODUCING LOGS OF SHEET MATERIAL

[75] Inventors: Renato Matteucci, San Gemignano di Moriano; Mauro Biagioni, Catiglione di Garfagnana; Giuseppe Lupi, Gallicano, all of Italy

[73] Assignee: Italconverting Srl, Mozzano, Italy

[21] Appl. No.: 09/005,943

[22] Filed: Jan. 7, 1998

[30] Foreign Application Priority Data

Jan. 10, 1997 [IT] Italy ..... MI97A0031

[51] Int. Cl.[7] ..... B65H 35/04; B65H 18/14

[52] U.S. Cl. ..... 242/527.3; 242/533.3; 242/542.2; 242/532.2

[58] Field of Search ..... 242/527.3, 533.3, 242/542.1, 542.2, 548, 527, 527.2, 532.2

[56] References Cited

U.S. PATENT DOCUMENTS 4,456,190 6/1984 Karttunen et al. ..... 242/527.3
4,601,441 7/1986 Oinnoen et al. ..... 242/527.3
5,249,756 10/1993 Biagiotti ..... 242/533.3

FOREIGN PATENT DOCUMENTS 4317946 11/1992 Japan .
WO 94/21545 9/1994 WIPO .

*Primary Examiner*—John Q. Nguyen
*Attorney, Agent, or Firm*—Sheridan Ross P.C.

[57] ABSTRACT

A rewinding machine and method for producing rolls or logs (1) of sheet material (W) around a tubular core (2), comprising a first winding roller (A) around which the sheet material (W) is directed, a second winding roller (B) forming a throat (3) with the first roller (A) through which the core (2) is introduced and a third roller (C) mounted mobile to allow the diameter of the log (1) to increase and the log to be discharged at the end of winding, in which a cutting blade (17) is provided that can be brought cyclically into contact with a portion of the web comprised between a new core (2) being introduced into the winding cradle and the made-up log being moved away, to cause separation thereof.

18 Claims, 5 Drawing Sheets

W
R 18
17
15
C
6
A
1
3
9
2
8
B
10
11
12
14
13

MACHINE AND METHOD FOR PRODUCING LOGS OF SHEET MATERIAL

FIELD OF THE INVENTION

The present invention relates to a rewinding machine and relative rewinding method for producing rolls or logs of sheet material, such as paper and the like, on a tubular support.

BACKGROUND OF THE INVENTION

The rewinding machine according to the invention is of the so-called peripheral winding type, that is, in which the roll is wound around a tubular core that is set in rotation between a group of three rollers that act on the periphery of the roll being formed and whose speeds are kept constant during the winding cycle.

The group of three motorized rollers forms a space of variable size so that the three roller are always in contact with the roll being made up, as said roll gradually increases in diameter. Two of the three rollers are placed at a set distance so as to define a throat through which the core is inserted and in which the sheet travels, whilst the third roller or pressure roller is mobile to allow the roll to increase in diameter and be discharged at the end of winding.

Of importance in these rewinding machines is the so-called changeover stage, that is, insertion of a new core in the winding space, accompanied by a special inserter, and unloading of the completed log, following breaking of the web of material.

This is achieved in a variety of ways according to the prior art, generally requiring sudden changes in the speed of two of the three winding rollers.

According to some known methods, the change in speed of these rollers causes tensioning and tearing of the web of paper following pinching thereof against the roller on which it is wound, pinching that can occur by means of the new core that is being inserted into the winding cradle. After breakage of the paper web, entry of the new core into the winding space and discharge of the made-up log take place through the difference in speed between the two input rollers and the two output rollers, respectively.

The system with tearing of the paper requires strong accelerations of the pressure roller, which cause stress on the machine structure, and does not guarantee precise cutting of the paper web.

BRIEF SUMMARY OF THE INVENTION

The object of the invention is to provide a rewinding machine and a method that ensure precise cutting of the sheet material.

Another object of the invention is to ensure rapid take-up on the new core of the leading edge of the cut web, without any creases forming.

Yet another object of the invention is to allow take-up of the leading edge of the web on the new core with or without the use of glue.

The invention has the characteristics listed in the appended independent claims.

Preferred embodiments of the invention emerge from the dependent claims.

In particular, according to the invention, an oscillating blade carried by an arm having its fulcrum in the center of the roller around which the web material is wound is provided, a blade which comes down cyclically on a tensioned portion of material to accomplish breaking thereof, moving in synchronism with the core introducing mechanism and the means that permit discharge of the made-up log.

The rocker arm carrying the cutting blade is operated by the same mechanism that controls the core inserter.

Further characteristics of the invention will be made clearer by the detailed description that follows, referring to a purely exemplary and therefore non-limiting embodiment thereof, illustrated in the appended drawings, in which:

DETAILED DESCRIPTION

Figure 1:
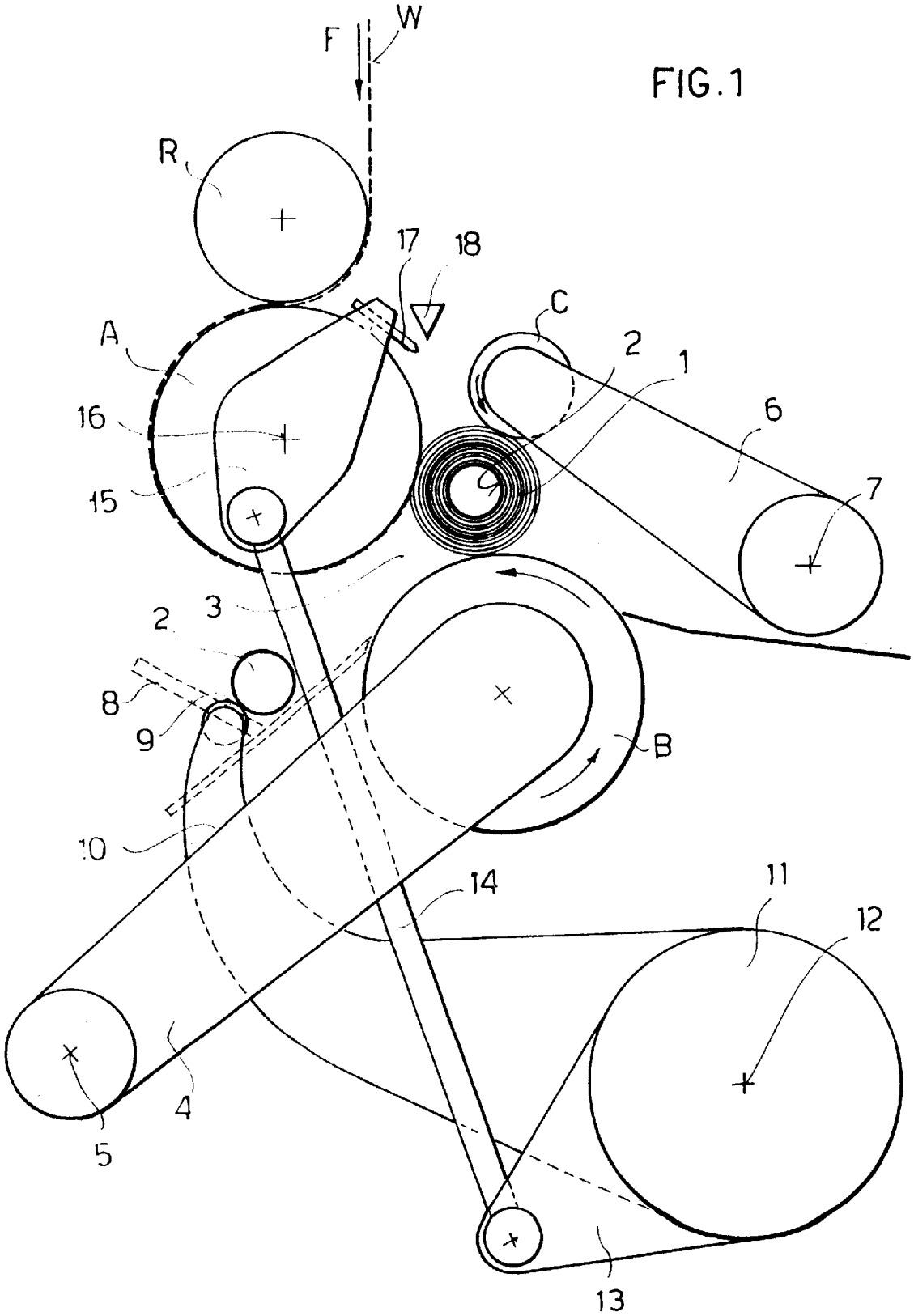
FIG. 1 is a diagrammatic side view of the basic elements of the rewinding machine illustrating a first stage in the winding cycle.

In the description that follows the elements shown in the drawings will be referred to in the singular, it being clear, however, that many of them, such as arms and levers, are arranged in pairs.

In the appended figures, W indicates a web of material, particularly paper, which is unwound from a large sized roll, not shown, and, advancing in the direction of the arrow F, is suitably tensioned by a roller R and directed around a first winding roller A, to be re-wound in rolls or logs 1, with a considerably smaller diameter, around a central core 2.

The first winding roller A is combined with a second winding roller B, which forms a throat 3 therewith, through which the cores 2 are inserted. The width of the throat 3, during operation of the machine, is constant and no greater than the diameter of the core, so that the latter enters the throat with slight forcing. The second winding roller B is supported by a mobile arm 4, having its fulcrum at 5, to adjust the width of the throat 3 to the diameter of the core 2 that is used.

The group of three winding rollers is completed by a third roller C, also called the pressure roller, supported by an arm 6 mobile around a fulcrum 7, according to pre-established law of motion, to allow the diameter of the roll 1 to increase and the roll to be discharged at the end of winding.

Upstream of the throat 3 a slide 8 is provided for feeding of the cores 2 and a core inserting device comprising idle rollers 9 carried on the end of a beak-shaped arm 10, mounted on a shaft 11, whose axis of fulcrum is indicated by 12.

According to the invention, integral with said shaft 11 is a lever 13 which, by means of a stiff rod 14 acts on a lever 15, having its fulcrum on the axis 16 of the first winding roller A, and bearing, at the opposite end with respect to the fulcrum 16, a cutting blade 17.

With such a structure, a clockwise rotation of the shaft 11, starting from the position in FIG. 1, causes, on the one hand, advancement of the core 2 toward the throat 3, by means of the arm 10, and on the other hand, lowering of the blade 17, by means of a leverage 13, 14, 15, thus causing cutting of the web W.

Above the winding cradle, in the space between rollers A and C, nozzles 18 are provided which blow air downwards, at the time of cutting, to facilitate take-up of the leading edge of the web material on the new core, as will be better described below.

Operation of the machine will now be illustrated making reference to the sequence of stages illustrated in FIGS. 1 to 5.

FIG. 1 shows the machine configuration in the vicinity of the changeover, that is roughly at the end of winding of roll 1, when said roll is about to be discharged and a new core 2 must be inserted.

The three rollers A, B, C all turn at a constant and substantially equal speed, a speed that corresponds to that at which the sheet material W is fed.

The blade 17 is in the resting position, as is the core inserting arm 10.

Figure 2:
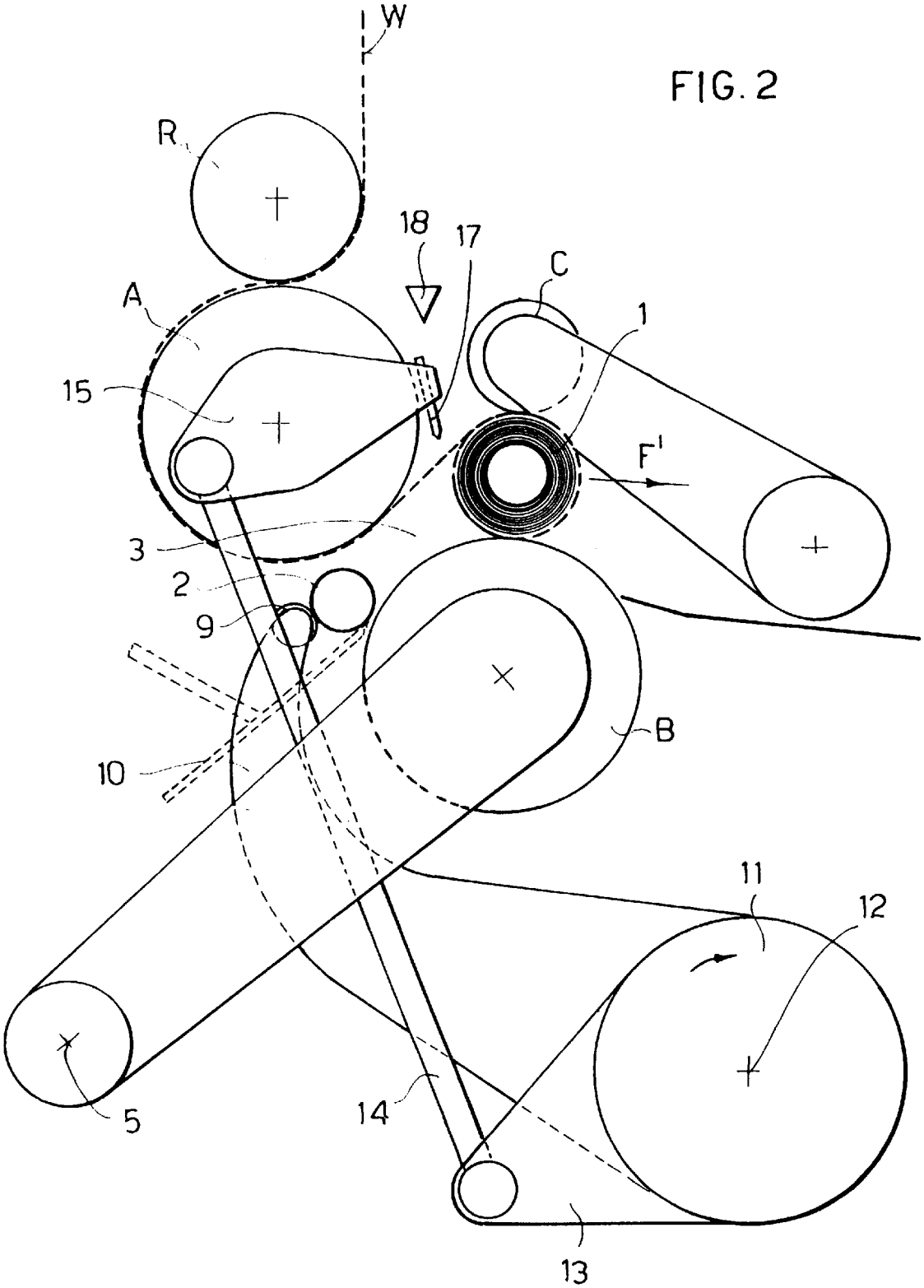
FIG. 2 is a diagrammatic side view of the basic elements of the rewinding machine illustrating a second stage in the winding cycle.

In FIG. 2 the log 1 has practically been completed. The bottom roller B has begun to slow down and the log being formed 1 moves toward the outlet in the direction of the arrow F', rolling on the roller B, because of the difference in speed between this and the roller C. The shaft 11 begins a movement of clockwise rotation, making the blade 17 descend through the leverage 13, 14, 15, and pushing the new core 2 towards the throat 3, by means of the idle rollers 9 of the arm 10.

Figure 3:
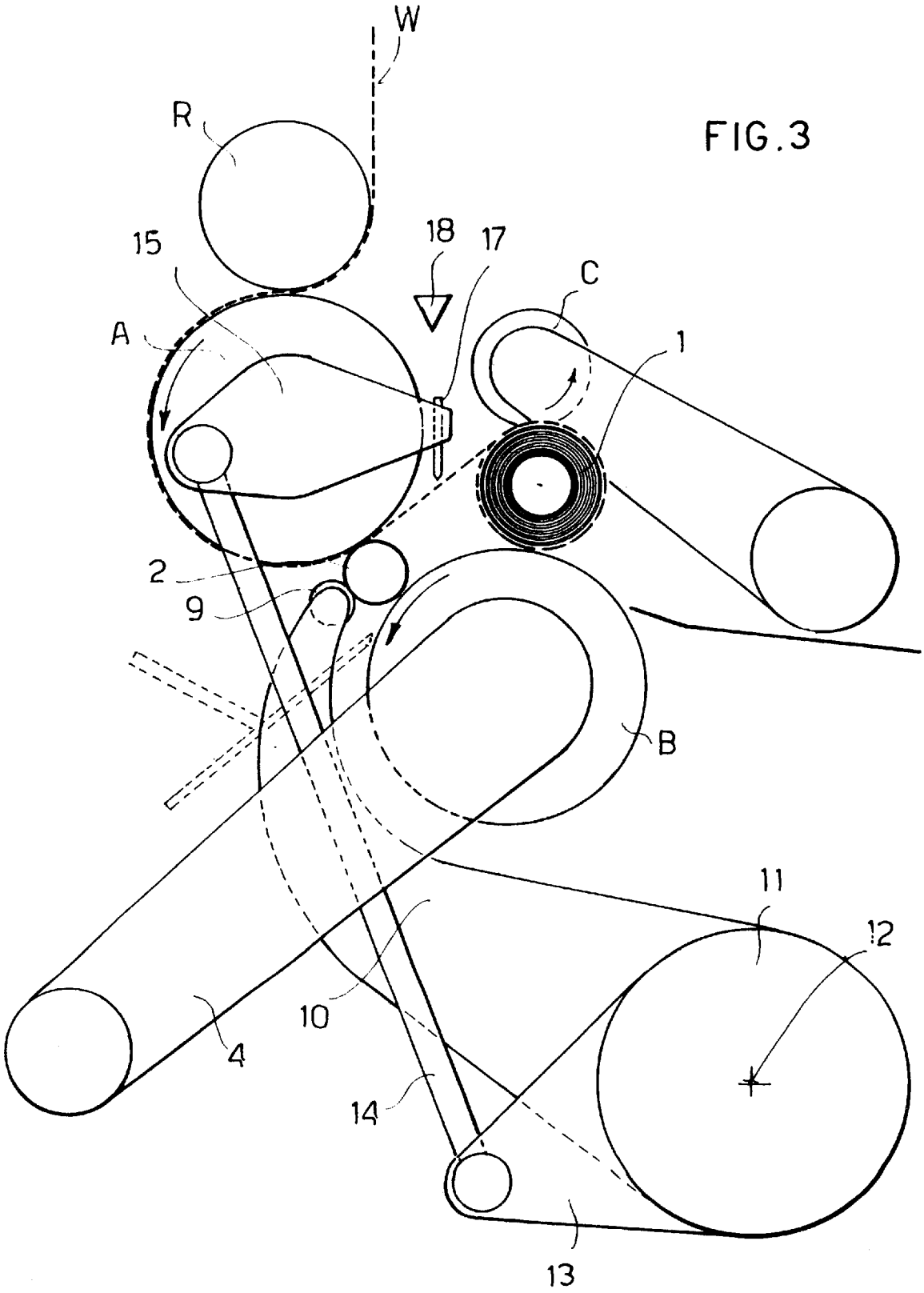
FIG. 3 is a diagrammatic side view of the basic elements of the rewinding machine illustrating a third stage in the winding cycle.

In the situation in FIG. 3, the bottom roller B is still decelerated with respect to the rollers A and C. The shaft 11 continues to turn clockwise, bringing the new core 2 almost into contact between the roller B and the paper wound on the roller A. At the same time, the blade 17 descends further, bringing itself into the immediate vicinity of the portion of web between the new core and the log 1 which has moved from the winding cradle.

Figure 4:
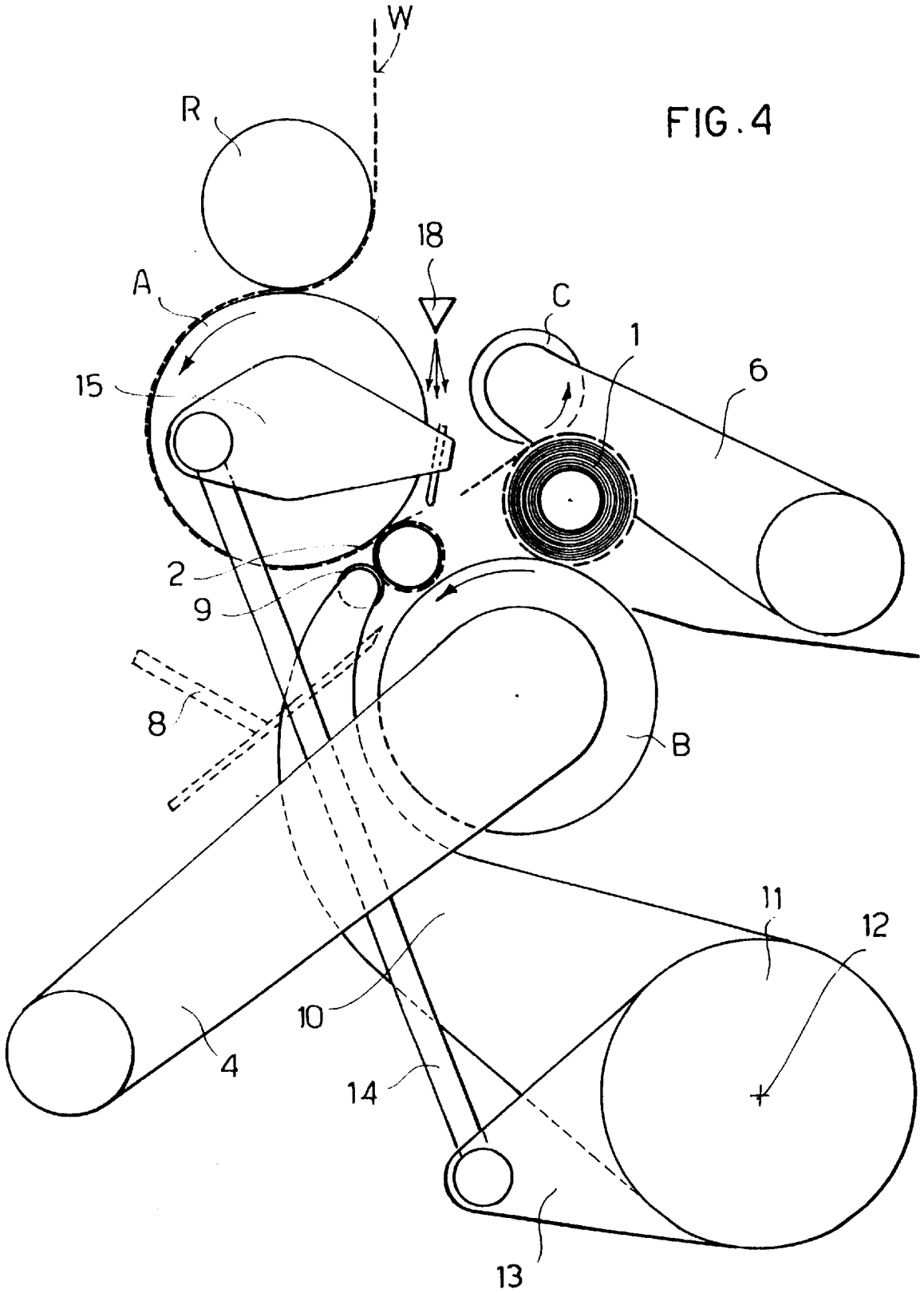
FIG. 4 is a diagrammatic side view of the basic elements of the rewinding machine illustrating a fourth stage in the winding cycle.

In the situation in FIG. 4, the roller B is still decelerated with respect to the roller A. The pressure roller C has begun the acceleration stage, which causes tensioning of the portion of web pinched against the roller A by the core. The blade 17 comes into contact with said portion of web in the vicinity of a crosswise perforated line thereof, causing it to be cut. Simultaneously with cutting, the nozzles 18, which send blasts of air onto the web, are activated, facilitating take-up of the leading edge on the new core 2, which is inserted into the winding cradle.

Obviously, the blade 17, depending upon the types of material to be wound, the various types of perforations used or the lack of perforation, can take on different configurations, for example with a continuous edge, serrated edge, or the like.

It is also obvious that the sequence of stages described in relation to FIG. 4 can also be slightly different. For example the pressure roller C, instead of accelerating immediately before cutting, to tension the web, could accelerate at the time of cutting, or even immediately after cutting, if the sheet material has a low coefficient of elasticity.

Figure 5:
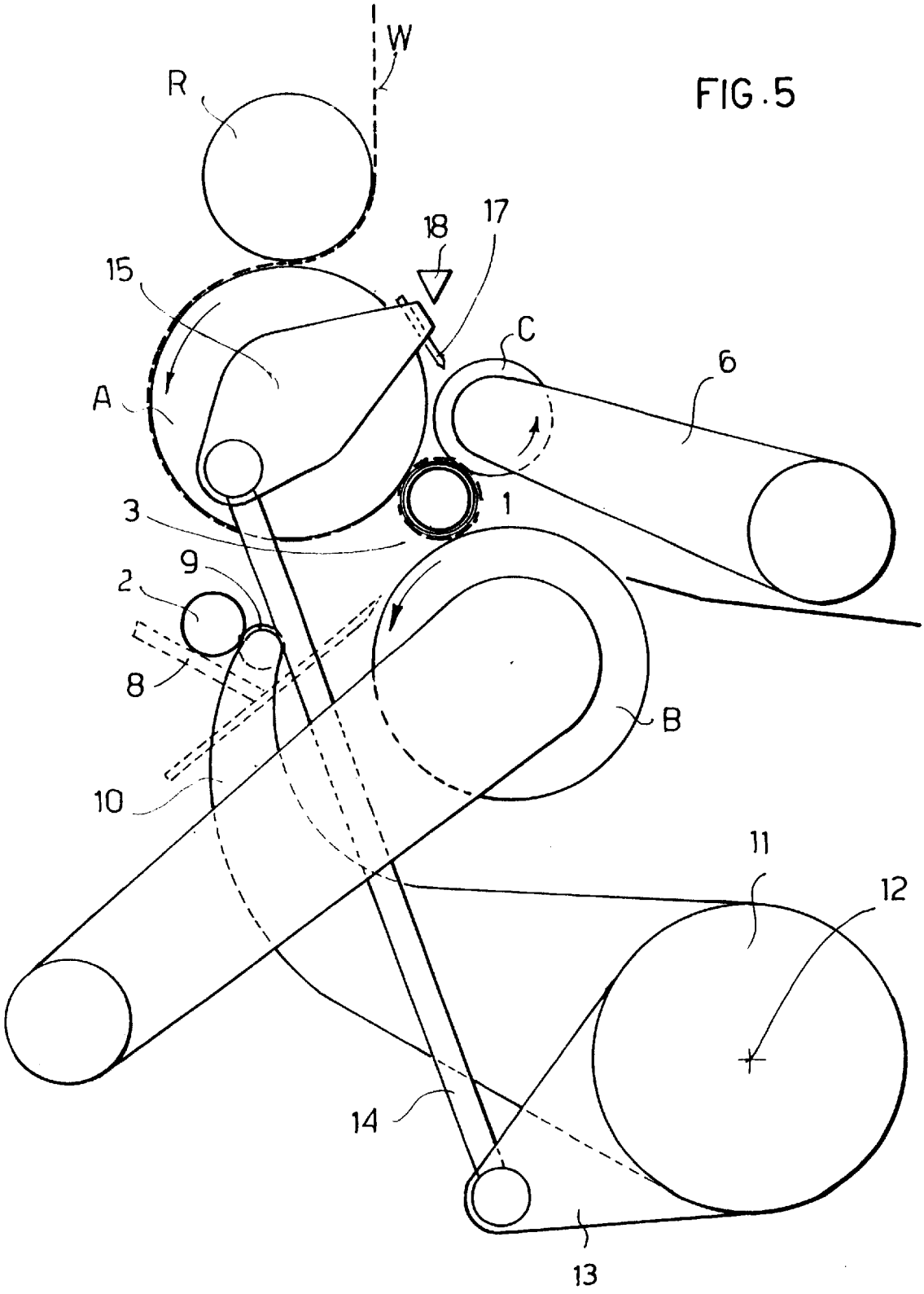
FIG. 5 is a diagrammatic side view of the basic elements of the rewinding machine illustrating a fifth stage in the winding cycle.

In FIG. 5, the made-up log has been expelled and a new log being made up is in the winding cradle. The shaft 11 is turning anti-clockwise, bringing the cutting blade 17 and the core inserting mechanism 9, 10 into their starting positions. The blasts of air from the nozzles 18 have completed their task, that is, that of helping the web to wind onto the new core. Obviously, the winding rollers A, B, C have begun to turn at a constant speed again.

The blowing nozzles 18 that facilitate take-up of the leading edge of the cut web onto the new core can be revised to allow operation of the rewinding machine with or without applying glue to the core.

We claim:

1. A peripheral rewinding machine for the production of logs of sheet material on tubular cores, comprising a first winding roller, on which the sheet material is directed, a second winding roller defining, with the first winding roller, a throat, through which the new core is introduced, a third winding roller mounted mobile to allow a diameter of the log to increase and the log to be discharged at the end of winding, means for separating the sheet material at the end of winding and means for inserting a new core, wherein said means for separating the sheet material comprises a blade that can be brought cyclically into contact with a portion of the sheet material in a winding cradle formed between the first, second and third winding rollers, the movement of the portion of the sheet material being delimited on one side, by the new core being inserted by a core inserting means into the throat between the first and second winding rollers and, on the other, by the log in a removal stage;

wherein said blade is carried by a rocking lever, said rocking lever having a fulcrum on the rotational axis of the first winding roller, on which the sheet material is directed.

2. A machine according to claim 1, further comprising nozzles that blow air at a cutting area of the sheet material.

3. A machine according to claim 1, further comprising nozzles that blow air at a cutting area of the sheet material.

4. A machine according to claim 1, further comprising nozzles that blow air at a cutting area of the sheet material.

5. A peripheral rewinding machine for the production of logs of sheet material on tubular cores, comprising a first winding roller, on which the sheet material is directed, a second winding roller defining, with the first winding roller, a throat, through which the new core is introduced, a third winding roller mounted mobile to allow a diameter of the log to increase and the log to be discharged at the end of winding, means for separating the sheet material at the end of winding and means for inserting a new core, wherein said means for separating the sheet material comprises a blade that can be brought cyclically into contact with a portion of the sheet material in a winding cradle formed between the first, second and third winding rollers, the movement of the portion of the sheet material being delimited on one side, by the new core being inserted by a core inserting means into the throat between the first and second winding rollers and, on the other, by the log in a removal stage, said blade being operated by a leverage that is controlled by a shaft that also controls said core inserting means.

6. A machine according to claim 5, characterized in that said core inserting means comprises idle rollers carried by a curved arm operated by said shaft.

7. A machine according to claim 6, further comprising nozzles that blow air at a cutting area of the sheet material.

8. A machine according to claim 5, further comprising nozzles that blow air at a cutting area of the sheet material.

9. A method for producing logs of sheet materials, such as paper, comprising directing the sheet material around a first winding roller, winding the sheet material around a tubular core set in rotation in a winding cradle formed between said roller and two other rollers, winding the sheet material around the tubular core to form a log, separating a sheet material at the end of winding of the log, wherein said separation occurs by means of a cutting blade, which is brought cyclically into contact with a portion of the sheet material located in the winding cradle, the movement of the portion of the sheet material being delimited by a new core being inserted by a core inserting means into the winding cradle and the log that is being removed; and controlling the movement of said cutting blade by a shaft that controls the core inserting means.

10. A method according to claim 9, further comprising accelerating the third roller immediately before, simultaneously with, or immediately after separation of the sheet material.

11. A method according to claim 10, further comprising blasting air towards an area of separation of the sheet material to facilitate winding onto the new core of the leading edge of the cut sheet material.

12. A method according to claim 9, further comprising blasting air towards an area of separation of the sheet material to facilitate winding onto the new core of the leading edge of the cut sheet material.

13. A method according to claim 9, further comprising decelerating the second roller before separation of the sheet material.

14. A method according to claim 9, further comprising accelerating the third roller immediately before, simultaneously with, or immediately after separation of the sheet material.

15. A method according to claim 9, further comprising blasting air towards an area of separation of the sheet material to facilitate winding onto the new core of the leading edge of the cut sheet material.

16. A method according to claim 9, further comprising decelerating the second roller before separation of the sheet material.

17. A method according to claim 16, further comprising accelerating the third roller immediately before, simultaneously with, or immediately after separation of the sheet material.

18. A method according to claim 16, further comprising blasting air towards an area of separation of the sheet material to facilitate winding onto the new core of the leading edge of the cut sheet material.

* * * * *

UNITED STATES PATENT AND TRADEMARK OFFICE

CERTIFICATE OF CORRECTION

PATENT NO. : 6,098,916
DATED : August 8, 2000
INVENTOR(S) : Renato, et al.

It is certified that error appears in the above-identified patent and that said Letters Patent is hereby corrected as shown below:

Title page,
Item [75], Inventors: Please delete "Catiglione" and insert -- Castiglione --.

Signed and Sealed this

Second Day of October, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,098,916
DATED : August 8, 2000
INVENTOR(S) : Matteucci et al.

It is certified that error appears in the above-identified patent and that said Letters Patent is hereby corrected as shown below:

Column 4,
Lines 31-34, please delete cancelled claims 2 and 3 as requested.

Signed and Sealed this

Sixth Day of December, 2005

JON W. DUDAS
*Director of the United States Patent and Trademark Office*